US006655174B2

(12) United States Patent
Moore

(10) Patent No.: US 6,655,174 B2
(45) Date of Patent: Dec. 2, 2003

(54) METHOD AND APPARATUS FOR INDIVIDUAL DISPOSABLE PACKAGES FOR FREEZABLE SUBSTANCES AND A CONTAINER THEREOF

(76) Inventor: Pamela R. Moore, P.O. Box 334, Tallmadge, OH (US) 44278

( * ) Notice: Subject to any disclaimer, the term of this patent is extended or adjusted under 35 U.S.C. 154(b) by 0 days.

(21) Appl. No.: 10/157,441

(22) Filed: May 29, 2002

(65) Prior Publication Data

US 2003/0001068 A1 Jan. 2, 2003

Related U.S. Application Data

(60) Provisional application No. 60/294,104, filed on May 29, 2001.

(51) Int. Cl.[7] ..... F25D 3/08; B28B 7/34; B28B 7/24

(52) U.S. Cl. ..... 62/530; 62/1; 249/61; 249/121

(58) Field of Search ..... 62/1, 530, 457.3, 62/457.2; 249/61, 117, 119, 121; 383/108, 901

(56) References Cited

U.S. PATENT DOCUMENTS

| | | | | |
|---|---|---|---|---|
| 26,429 | A | | 12/1859 | Halvorson |
| 139,858 | A | | 6/1873 | Blackman |
| 298,694 | A | | 5/1884 | Jewett |
| 1,688,888 | A | | 10/1928 | Spreen |
| 1,831,047 | A | | 11/1931 | Thomas |
| 1,953,167 | A | | 4/1934 | Geyer |
| 2,036,706 | A | | 4/1936 | Law |
| 2,083,081 | A | | 6/1937 | Moll |
| 2,132,879 | A | | 10/1938 | Pownall |
| 2,136,425 | A | | 11/1938 | Fields |
| 2,166,560 | A | | 7/1939 | Schmelzer |
| 2,247,018 | A | | 6/1941 | Henning |
| 2,247,019 | A | | 6/1941 | Henning |
| 2,291,672 | A | | 8/1942 | Youngberg |
| 2,411,193 | A | | 11/1946 | Cummins |
| 2,434,803 | A | | 1/1948 | Johnson et al. |
| 2,591,375 | A | * | 4/1952 | Radford ..... 62/130 |
| 2,594,127 | A | | 4/1952 | Collier |
| 2,704,928 | A | | 3/1955 | Curry |
| 2,713,543 | A | | 7/1955 | Peters |
| 2,796,742 | A | | 6/1957 | Platt |
| 3,025,682 | A | | 3/1962 | Kniffin |
| 3,113,672 | A | | 12/1963 | Brown |
| D202,529 | S | | 10/1965 | Rosebrook |
| 3,214,128 | A | | 10/1965 | Beck et al. |

(List continued on next page.)

FOREIGN PATENT DOCUMENTS

DE 200 15 104 U1 1/2001

OTHER PUBLICATIONS

PCT International Search Report—15–11–2002.
Brochure from Progressive International Corporation—Jan. 2003—2 pages.

*Primary Examiner*—William C. Doerrler
(74) *Attorney, Agent, or Firm*—Brouse McDowell; Roger D. Emerson; Heather M. Barnes

(57) ABSTRACT

An article for holding freezable substances includes an individual disposable package for holding the frozen substance and a container therefore. The package is comprised of a bottom portion and a top portion. The frozen substance is placed in the bottom portion and the top portion is placed over the bottom portion to seal the package and prevent spillage of the freezable substance prior to its freezing. The package has a maximum inner width Wm, with Wm being less than or equal to 0.875 inches (22.23 mm). The width Wm is chosen so that a long, cylindrical ice cube is formed by the package. The ice cube so formed fits easily into original containers of beverages, such as soda cans and bottles, so that the beverages are cooled in their original containers.

17 Claims, 4 Drawing Sheets

U.S. PATENT DOCUMENTS

| | | | | | |
|---|---|---|---|---|---|
| 3,340,798 | A | | 9/1967 | Winger | |
| 3,565,389 | A | | 2/1971 | Price | |
| 3,799,493 | A | | 3/1974 | Beck et al. | |
| 3,840,153 | A | * | 10/1974 | Devlin | 222/146.6 |
| D244,131 | S | | 4/1977 | Lalonde | |
| D244,275 | S | | 5/1977 | Gurbin | |
| D245,008 | S | | 7/1977 | LaLonde | |
| 4,091,632 | A | | 5/1978 | Marchewka et al. | |
| 4,148,457 | A | | 4/1979 | Gurbin | |
| 4,162,780 | A | | 7/1979 | Rankin | |
| 4,223,043 | A | * | 9/1980 | Johnson | 426/122 |
| 4,417,716 | A | | 11/1983 | Penna et al. | |
| D271,769 | S | | 12/1983 | Daenen et al. | |
| D281,696 | S | | 12/1985 | Barnhart | |
| D287,856 | S | | 1/1987 | Stewart | |
| D292,802 | S | | 11/1987 | Fails | |
| 4,735,063 | A | * | 4/1988 | Brown | 62/293 |
| 4,804,083 | A | | 2/1989 | Weeks | |
| 4,843,836 | A | | 7/1989 | Childers | |
| 4,883,251 | A | | 11/1989 | Manas | |
| D307,997 | S | | 5/1990 | Bernstein | |
| D309,905 | S | | 8/1990 | Weissman | |
| 4,981,022 | A | | 1/1991 | Snyder | |
| D318,281 | S | | 7/1991 | McKinlay | |
| 5,129,238 | A | * | 7/1992 | Schwartz et al. | 62/457.3 |
| 5,188,744 | A | | 2/1993 | Silverman | |
| 5,201,194 | A | | 4/1993 | Flynn, Jr. et al. | |
| 5,235,823 | A | * | 8/1993 | Coker | 62/530 |
| 5,250,315 | A | | 10/1993 | Loew et al. | |
| 5,357,761 | A | | 10/1994 | Schauer | |
| D352,045 | S | | 11/1994 | Daenen et al. | |
| 5,393,032 | A | * | 2/1995 | Cederroth | 249/61 |
| 5,397,097 | A | | 3/1995 | Dale | |
| 5,456,090 | A | | 10/1995 | McCoy | |
| 5,467,877 | A | | 11/1995 | Smith | |
| 5,502,981 | A | | 4/1996 | Sullivan | |
| 5,507,156 | A | | 4/1996 | Redmon | |
| 5,590,542 | A | | 1/1997 | Wang | |
| 5,597,087 | A | | 1/1997 | Vinarsky | |
| 5,609,039 | A | | 3/1997 | Green et al. | |
| 5,806,338 | A | | 9/1998 | Schwartz et al. | |
| 5,971,352 | A | * | 10/1999 | Kirks | 249/117 |
| 6,182,452 | B1 | * | 2/2001 | Wright et al. | 62/1 |
| 6,345,802 | B2 | * | 2/2002 | Moore | 249/117 |
| 6,422,753 | B1 | * | 7/2002 | Thomas | 383/209 |
| 6,471,402 | B1 | * | 10/2002 | Burns | 383/32 |
| 2002/0050150 | A1 | | 5/2002 | Moore | |

* cited by examiner

METHOD AND APPARATUS FOR INDIVIDUAL DISPOSABLE PACKAGES FOR FREEZABLE SUBSTANCES AND A CONTAINER THEREOF

This utility patent application claims priority from a provisional patent application having Ser. No. 60/294,104, which was filed on May 29, 2001.

BACKGROUND OF THE INVENTION

1. Field of the Invention

This invention pertains to methods and apparatuses for chilling beverages, and more specifically to methods and apparatuses for making an individual disposable package for freezable substances that is contained within a container, wherein the freezable substances, once frozen, have an elongated, narrow form such that they can be removed from the disposable package and inserted into a beverage container, beverage can, juice can, water bottle, sports bottle or the like and can more effectively cool the entire depth of the beverage.

2. Description of the Related Art

Basic "cube-shaped" ice "cubes" and ice cube trays are known in the prior art. Typically, ice cube trays are designed to produce ice cubes having a cubic or rectangular form. The prior art also teaches ice cube trays which produce ice cubes having a variety of forms. For example, in U.S. Pat. No. 4,417,716 an ice tray is disclosed which forms completely enclosed chambers of different shaped ice. Further, in Des. 287,856 another shaped ice cube tray is disclosed. Other designs are disclosed in U.S. Des. Pat. Nos. D244,275; D292,802; and D318,281.

In addition, the manufacture and sale of pre-packaged containers of ice to consumers is also well known in the art. Bags of pre-packaged ice can be purchased at almost any gas station, convenience store or grocery store in the country. Similarly, most stores also sell pre-packaged containers of reusable "ice-cubes". These reusable "ice cubes" consist of a plastic mold filled with a freezable substance (usually water). The plastic mold including the freezable substance is frozen and the mold is placed in a beverage container to cool the beverage. Once the freezable substance melts, the mold can be refrozen and reused.

Notwithstanding the fact that the prior art teaches both ice cubes having a variety of forms and the pre-packaging of ice cubes, the prior art does not teach individual disposable packages for frozen substances, containers for these disposable packages, or a method of freezing a substance such that the freezable substance, once frozen, has an elongated form such that the frozen substance is insertable into a beverage container, beverage can, juice can, water bottle, sports bottle or the like and resultingly more effectively cools the entire depth of the beverage.

For example, a conventional beverage can has a depth of about 5.0 inches (127 mm) and has an opening with a width of about 0.75 inches (19.05 mm). Beverage containers such as water, soda or beverage bottles have various depths ranging from about 11.0 inches (279.4 mm) for a typical polyester two liter bottle to about 6.0 inches (152.4 mm) for a typical bottled water bottle. These containers also have openings of various widths. Neither the conventional cubic or rectangular ice cubes, nor the various forms of ice cubes that the prior art teaches, are insertable within these containers because of the narrowness of the containers' openings. Consequently these beverages can not be easily cooled in their containers by the addition of ice cubes or other frozen substances. The only way to cool these beverages while they are in their containers is to place them into a cool environment such as a refrigerator, freezer, ice box, ice bucket, cooler, tub of ice, or the like. However, the introduction of a beverage container into a very cold environment can lead to a messy result as the beverage container may rupture as the freezable substance within the container expands during freezing.

Furthermore, when a straw is used to consume a beverage, the use of conventional ice cubes in the beverage does not achieve the advantages offered by the current invention. It is common knowledge that when ice is added to a beverage, the ice floats. Consequently, the upper, rather than the lower, portion of the beverage is cooled. When a straw is used to consume the beverage, the non-cooled lower portion of the beverage is sucked up through the straw and introduced into the consumer's mouth rather than the cooled upper portion of the beverage wherein the ice cubes reside. This is dissatisfying and contrary to the motives behind adding ice cubes to beverage containers; namely, consuming a cool beverage. The current invention solves this problem. The elongated form of the current invention assures that the frozen substance is narrow and insertable into a beverage container, beverage can, juice can, water bottle, sports bottle or the like and that the lower portion of the beverage, from which the beverage is consumed when the consumer uses a straw, is cooled.

SUMMARY OF THE INVENTION

According to one aspect of the invention, an individual disposable package for freezable substances is provided. The package is made of a polymeric material, such as polyethylene. The disposable package has a maximum width, Wm, which is less than or equal to 0.875 inches (22.23 mm).

Another object of the present invention is to provide an article for a freezable substance, wherein the article comprises an elongated bottom portion, the bottom portion being adapted to hold an associated freezable substance; and an elongated top portion, where the elongated top portion receives the bottom portion, the top portion is selectively and at least partially removable from the bottom portion, and the bottom and top portions form an individual package and define a cavity therein for the freezable substance.

It is yet another object of the present invention to provide an article further comprising a container, where the container is adapted to hold the individual package.

Still yet, another object of the present invention is to provide an article wherein the container holds up to eight individual packages.

It is yet another object of the present invention to provide an article for a freezable substance comprising a plurality of individual packages, where each of the packages results in a frozen substance, and each of the individual packages comprises an elongated bottom portion adapted to hold an associated freezable substance and an elongated top portion receiving the bottom portion, where the top portion is selectively and at least partially removable from the bottom portion and the bottom and top portions form an individual package and define a cavity therein for the freezable substance, each of said individual packages being formed from a polymeric material; and, a polymeric container for holding the plurality of individual packages.

According to another aspect of the invention the disposable package has a maximum width, Wm, which is less than or equal to 0.625 inches (15.875 mm).

According to another aspect of the disposable package has a length X, wherein the length X is greater than or equal to 1.5 inches (38.1 mm).

According to another aspect of the invention the width of the package is less than or equal to 0.875 inches (22.23 mm) at any point along its length.

According to another aspect of the invention the width of the package is less than or equal to 0.625 inches (15.875 mm) at any point along its length.

According to another aspect of the invention the disposable package is comprised of a bottom portion and a top portion, wherein the freezable substance is placed in the bottom portion and the top portion is placed over the bottom portion to seal the package and prevent spillage of the freezable substance prior to its freezing.

According to another aspect of the invention at least one individual disposable package for freezable substances is placed in a container for efficient marketing and storage.

Still other benefits and advantages of the invention will become apparent to those skilled in the art to which it pertains upon a reading and understanding of the following detailed specification

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
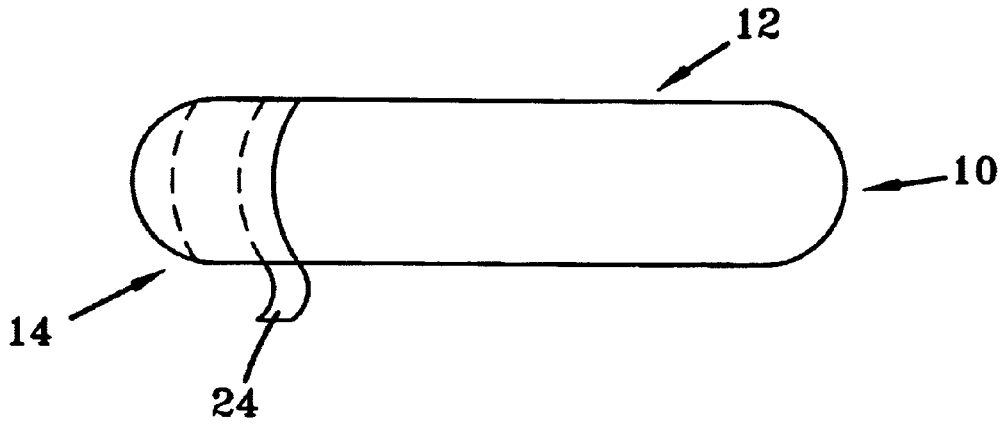
FIG. 1 is a view of an individual disposable package for freezable substances.
Figure 2:
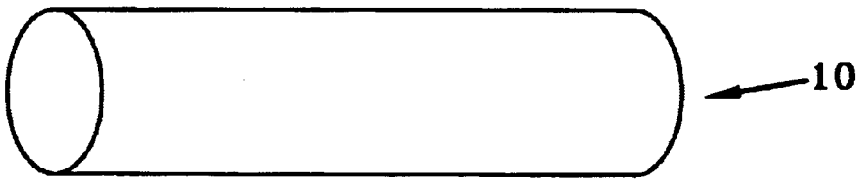
FIG. 2 is another view of an individual disposable package for freezable substances.
Figure 3:
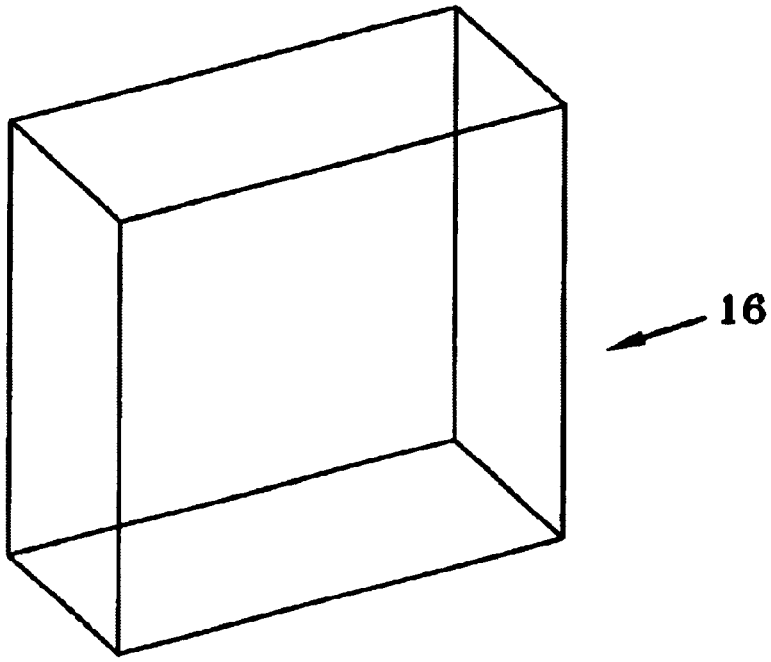
FIG. 3 is a view of an empty transparent container.
Figure 4:
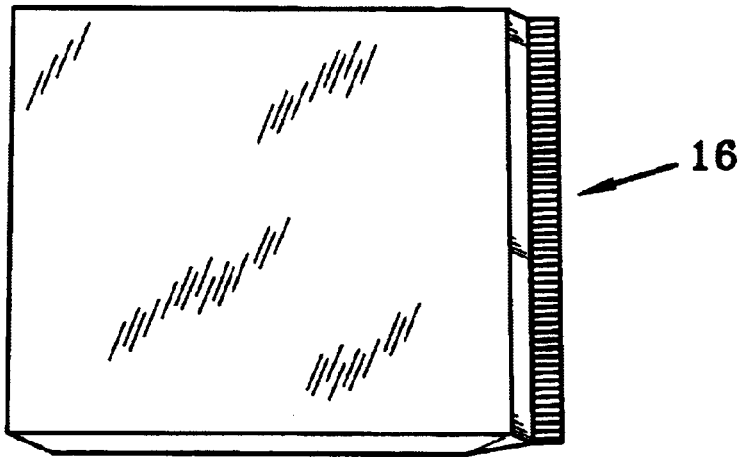
FIG. 4 is another view of an empty transparent container.
Figure 5:
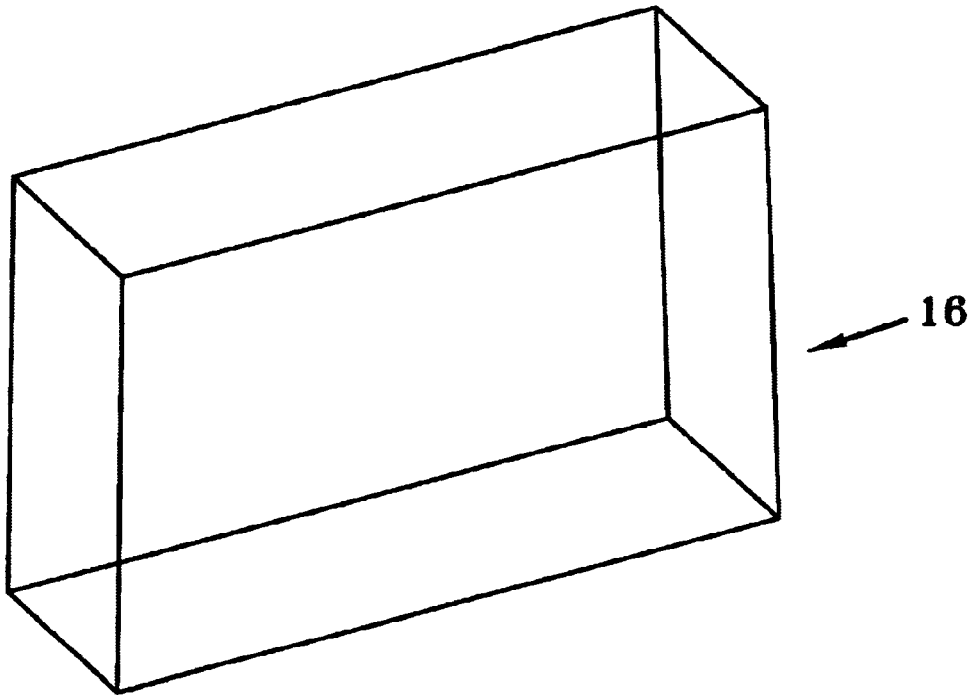
FIG. 5 is a view of a non-transparent container.
Figure 6:
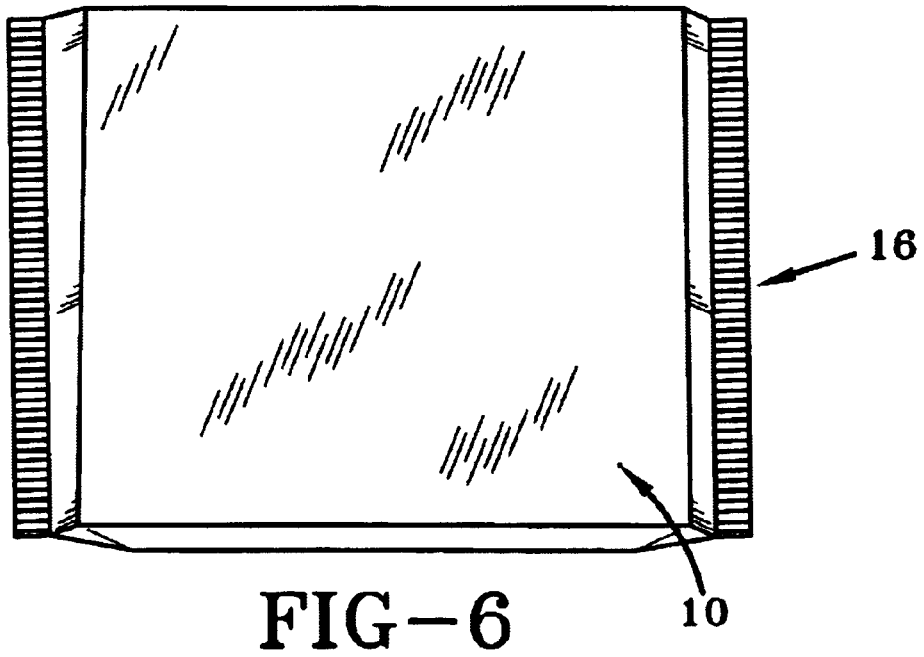
FIG. 6 is a view of the container holding four individual disposable packages for freezable substances.
Figure 7:
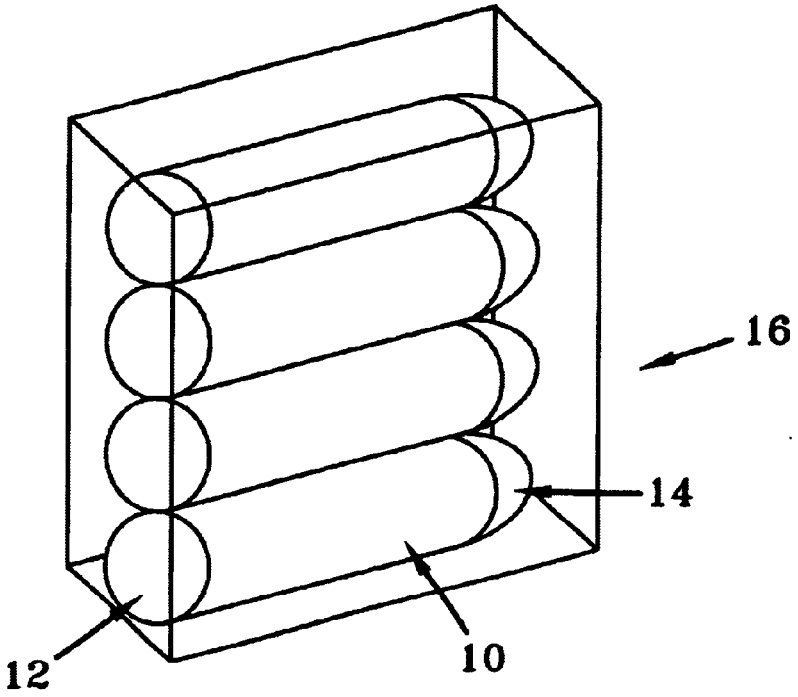
FIG. 7 is another view of a container holding four individual disposable packages for freezable substances; and, FIG. 8 is a view of the container holding eight individual disposable packages for freezable substances.
Figure 8:
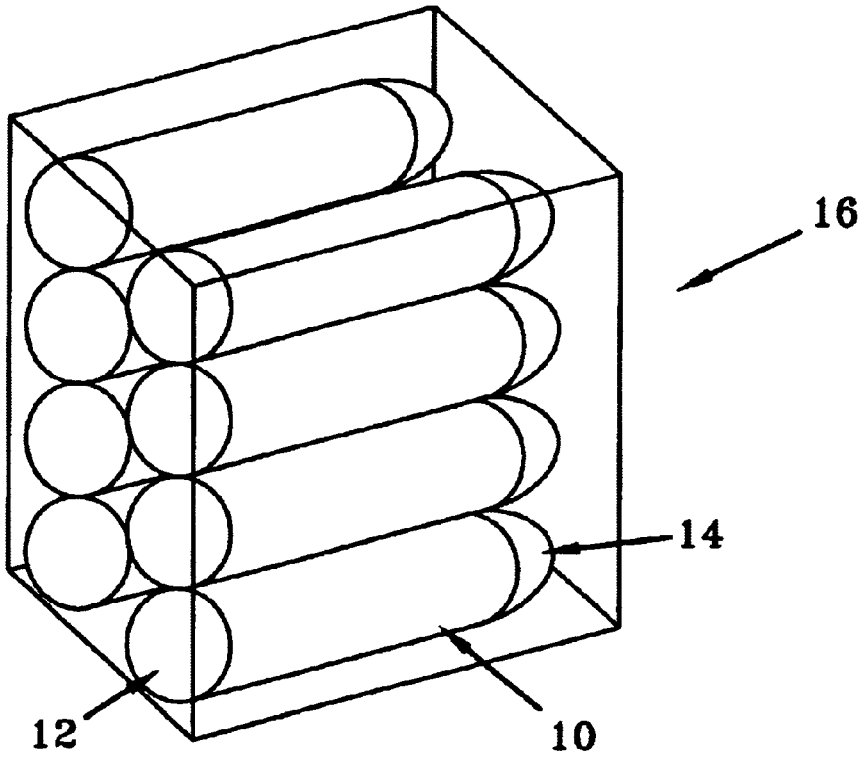

Referring now to the drawings wherein the showings are for purposes of illustrating a preferred embodiment of the invention only and not for purposes of limiting the same, FIGS. 1 and 2 show an individual disposable package 10, FIGS. 3–5 show containers 16 for the disposable packages 10 and FIGS. 6–8 show the individual disposable packages 10 in the container 16. Throughout this specification, the terms "ice cube" and "ice cube tray" will be used for convenience of the reader, even though the shape and form of the ice formed by the inventive structure is not cubic. In addition, while the invention will be referred to in the context of freezing water to form ice, any freezable substance is within the scope of this invention.

With reference to FIGS. 1 and 2, an individual disposable package 10 is shown having a top portion 12 and a bottom portion 14. A freezable substance is placed in the bottom portion 14 and the top portion 12 is placed over the bottom portion 14 to seal the package and prevent spillage of the freezable substance prior to its freezing. The top and the bottom portions 12 and 14 each have a maximum width Wm of less than or equal to 0.625 inches (15.875 mm). The disposable package 10 has a length $X_l$ of greater than or equal to 1.5 inches (38.1 mm).

In the preferred embodiment, the freezable substance is placed in the bottom portion 14 of the package 10 and the top portion 12 is placed over the bottom portion 14 to seal the package 10. However, the top and bottom portions 12 and 14 of the package 10 can be sealed prior to placing the freezable substance in the package 10. After the top and bottom portions 12 and 14 are sealed, the freezable substance can be placed in the package 10 via at least one opening (not shown) that is located on either the top portion 12, the bottom portion 14 (or at least two openings which are located on the top portion and the bottom portion 12 and 14, respectively). The opening can then be sealed by any sealing means, such as, adhesives, pressure sealing, "zip-loc" mechanism or a lid, which seals the opening and prevents spillage.

In the preferred embodiment, the ice cube is removed from the package 10 by separating the top and bottom portions 12 and 14 from each other. However, the ice cube can be removed from the package 10 by any means chosen with sound engineering judgment, such as those described herein-below with reference to the package 10 comprised of a single unit (not shown).

The maximum width Wm is important, as the primary goal of the invention is to cool drinks within their respective containers. Because most of the drink containers presently have interior diameters less than 0.625 inches (15.875 mm), the present invention provides a way to effectively cool the beverage within its original container. Further, because the ice cube is now "narrow," and because cooling is a function of surface area, the length of the ice cube is necessarily lengthened in order to provide the requisite level of cooling. Therefore, in an ice cube formed by the inventive article, the depth $X_d$ is greater than a conventional ice cube. Also because of the greater surface area afforded, the preferred form of the cavity is one that will provide a generally cylindrical shaped ice cube.

In addition to the foregoing, another embodiment is contemplated wherein the package 10 has an inner width less than or equal to 0.875 inches (22.23 mm) at any point along its length.

In addition to the foregoing, another embodiment is contemplated wherein the package 10 has an inner width less than or equal to 0.625 inches (15.875 mm) at any point along its length.

In the preferred embodiment, the individual disposable package 10 is comprised of the top portion 12 and the bottom portion 14, but the disposable package 10 may be comprised of a single unit (not shown). However, the package 10 may be formed from a single tube having at least one opening. The opening can be located at any position on the tube that is chosen with sound engineering judgment. A freezable substance can be placed into the tube through the one opening and the tube can be sealed to prevent spillage of the freezable substance prior to its freezing. Any sealing means, such as, adhesives, pressure sealing, "zip-loc" mechanism or a lid, which seals the package and prevents spillage may be used.

The ice cube can be removed from the package 10 by any means that allows the ice tube to be removed from the package 10 without breaking or other such damage. For example, one end of the package 10 could be cut, torn, etc., to enable the ice cube to be removed from the package 10. Or, a perforation could be located along either the width or the length of the package 10, which could be broken to enable the ice cube to be removed from the package 10.

In the preferred embodiment, the package 10 is formed from polyethylene. However, any other polymeric substance that adequately holds the freezable substance, prevents spillage, and is capable of withstanding freezing temperatures without significant distortions or defects may be used.

With reference to FIGS. 3–8, a container 16 for holding the individual disposable packages 10 will now be described. FIG. 3 shows a transparent container 16 manufactured from a polymeric material, such as polyethylene. In the preferred embodiment, the container 16 will hold four (4) individual disposable packages 10. The dimensions of the container 16 will vary depending on the dimensions of the packages 10. For example, a container 16 holding four (4) packages 10 having a length of 4.50 inches (114.30 mm) and an outer width of 0.875 inches (22.23 mm) will have a length of 5.875 inches (141.00 mm), a width of 3.50 inches (88.90 mm) and a height of 0.938 inches (23.825 mm).

In the preferred embodiment, the container 16 is manufactured from a transparent polymeric material. However, the container 16 may be manufactured from any material which adequately holds the packages 10 and is capable of withstanding freezing temperatures without significant distortions or defects may be used. In addition, the container 16 does not have to be made of a clear transparent material. The container 16 may be a colored transparency, it may be opaque, or it may be a solid color. The color and transparency of the container 16 is simply a matter of design preference.

In FIGS. 6 and 7, a container 16 holding four (4) individual disposable packages 10 is shown. However, the container 16 may hold more than four (4) packages 10, such as in FIG. 6, or it may hold less than four (4) packages 10 (not shown). Furthermore, FIGS. 6 and 7 show the packages 10 arranged in a single row, but the packages 10 can be placed in any stable arrangement, such as the double rows shown in FIG. 8.

The inventive method of chilling a beverage within its original beverage container will now be described. In a typical beverage container, the lid is removed, typically by unscrewing the lid from the container via threads. An individual disposable package 10 is removed from the container 16, and then the frozen substance is removed from the package 10 and inserted into the beverage container so that the longitudinal centerline of frozen substance is coaxial with the longitudinal centerline of the beverage container. The entire depth of the beverage is therefore cooled and chilled by the inventive article.

In the preferred embodiment, the frozen substance will be removed from the package 10 by removing the top portion 12 of the package 10 and squeezing the bottom portion 14 of the package 10 to expel the frozen substance. However, different methods of removal may be used depending on the type of package 10. For example, if the package 10 is sealed, the frozen substance may be removed by tearing or cutting one end of the package 10 and squeezing the package 10 to expel the frozen substance through the opening. Or, if the package 10 has a lid, the lid can be taken off and then the frozen substance can be removed from the package 10.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

What is claimed is:

1. An article for a freezable substance, the article comprising:

an elongated bottom portion, said elongated bottom portion adapted to hold an associated freezable substance; and, an elongated top portion, said elongated top portion receiving said bottom portion, said top portion being selectively and at least partially removable from said bottom portion, said bottom and top portions forming an individual package and defining a cavity therein for the freezable substance.

2. The article of claim 1, wherein said bottom portion has a maximum width or equal to 0.625 inches (15.875 mm).

3. The article of claim 1, wherein said top portion has a maximum width less than or equal to 0.625 inches (15.875 mm).

4. The article of claim 1, wherein said package has a length greater than or equal to 1.5 inches (38.1 mm).

5. The article of claim 1, wherein said package has an inner width less than or equal to 0.875 inches (22.225 mm).

6. The article of claim 1, wherein said package has an inner width less than or equal to 0.625 inches (15.875).

7. The article of claim 1, wherein said package is formed from a polymeric material.

8. The article of claim 1, further comprising a container, said container adapted to hold said individual package.

9. The article of claim 8, wherein said container holds up to four individual packages.

10. The article of claim 8, wherein said container is formed from a polymeric material.

11. A package for forming an ice cube that readily passes through a bottle neck, the package comprising:

an elongated bottom portion, said bottom portion adapted to hold an associated freezable substance, said bottom portion defining a cavity therein; and, an elongated top portion, said elongated top portion adapted to be placed over said bottom portion to seal said package to prevent spillage of an associated freezable substance.

12. The package of claim 11, wherein said top portion is selectively removable from said bottom portion.

13. The package of claim 12, wherein said top portion is perforated so that said top portion may be selectively removable from said bottom portion.

14. An article for a freezable substance, comprising:

a plurality of individual packages, each of said packages adapted to form a frozen substance, each of said individual packages, comprising:

an elongated bottom portion, said bottom portion adapted to hold the freezable substance; and, an elongated top portion, said elongated top portion receiving said bottom portion, said top portion being selectively and at least partially removable from said bottom portion, said bottom and top portions forming an individual package and defining a cavity therein for the freezable substance, each of said individual packages being formed from a polymeric material; and, a polymeric container for holding said plurality of individual packages.

15. A method for utilizing an article for a freezable substance, comprising the steps of:

providing an elongated bottom portion, said bottom portion adapted to hold the freezable substance, and an elongated top portion, said elongated top portion receiving said bottom portion, said top portion being selectively and at least partially removable from said bottom portion, said bottom and top portions forming an individual package and defining a cavity therein for the freezable substance;

filling said bottom portion with the freezable substance;

placing said top portion over said bottom portion;

sealing said package to prevent spillage of the freezable substance; and, freezing the freezable substance.

16. The method of claim 15, further comprising the step of:

removing said top portion from said bottom portion; and, releasing the frozen freezable substance from said bottom portion.

17. The method of claim 16, further comprising the step of:

placing the frozen freezable substance past an associated bottle neck of a bottle; and, cooling an associated liquid disposed within the bottle.

* * * * *